US009421764B2

(12) United States Patent
Van Brocklin et al.

(10) Patent No.: US 9,421,764 B2
(45) Date of Patent: Aug. 23, 2016

(54) WAVEFORM SELECTION AND/OR SCALING FOR DRIVING NOZZLE OF FLUID-JET PRINTING DEVICE

(75) Inventors: Andrew L. Van Brocklin, Corvallis, OR (US); Eric T. Martin, Corvallis, OR (US); Neel Banerjee, Coravllis, OR (US)

(73) Assignee: HEWLETT PACKARD DEVELOPMENT COMPANY, L.P., Houston, TX (US)

( * ) Notice: Subject to any disclaimer, the term of this patent is extended or adjusted under 35 U.S.C. 154(b) by 52 days.

(21) Appl. No.: 14/235,154

(22) PCT Filed: Aug. 31, 2011

(86) PCT No.: PCT/US2011/050092

§ 371 (c)(1),
(2), (4) Date: Jan. 27, 2014

(87) PCT Pub. No.: WO2013/032475

PCT Pub. Date: Mar. 7, 2013

(65) Prior Publication Data

US 2014/0152726 A1 Jun. 5, 2014

(51) Int. Cl.
*B41J 29/38* (2006.01)
*B41J 2/045* (2006.01)

(52) U.S. Cl.
CPC ..... *B41J 2/04588* (2013.01); *B41J 2/0458* (2013.01)

(58) Field of Classification Search
CPC ..... B41J 2/04581; B41J 2/04541; B41J 2/04588; B41J 2/0458; B41J 2/04573; B41J 29/38
USPC ..... 347/9–11, 14
See application file for complete search history.

(56) References Cited

U.S. PATENT DOCUMENTS

| | | | | |
|---|---|---|---|---|
| 6,276,772 | B1 | 8/2001 | Sakata et al. | |
| 6,328,397 | B1 | 12/2001 | Shimizu et al. | |
| 6,428,134 | B1 | 8/2002 | Clark et al. | |
| 7,396,096 | B2 | 7/2008 | Kobayashi et al. | |
| 7,591,520 | B2 | 9/2009 | Iwao | |
| 7,645,009 | B2 | 1/2010 | Fujimori | |
| 7,712,854 | B2 | 5/2010 | Ou et al. | |
| 7,722,145 | B2 | 5/2010 | Kubota | |
| 2007/0195120 | A1 | 8/2007 | Kim et al. | |
| 2008/0150977 | A1 | 6/2008 | Harvey | |
| 2011/0080444 | A1* | 4/2011 | Kaieda et al. | 347/11 |

FOREIGN PATENT DOCUMENTS

| | | |
|---|---|---|
| JP | 2005153378 | 6/2005 |
| JP | 2008173910 | 7/2008 |

* cited by examiner

*Primary Examiner* — Jannelle M Lebron
(74) *Attorney, Agent, or Firm* — Dierker & Kavanaugh, PC

(57) ABSTRACT

A controller is for driving a nozzle of a fluid-jet printing device. The controller can select a waveform from a number of waveforms based at least on values for the nozzle. The controller can scale the waveform based on the values for the nozzle. The waveform drives the nozzle to cause the nozzle to eject fluid therefrom.

12 Claims, 5 Drawing Sheets

WAVEFORM SELECTION AND/OR SCALING FOR DRIVING NOZZLE OF FLUID-JET PRINTING DEVICE

BACKGROUND

Fluid-jet printing devices eject fluid onto media, such as paper. The fluid can be ejected in accordance with a desired image to be formed on the media. Different fluid-jet technologies include piezoelectric and inkjet technologies. Piezoelectric printing devices employ membranes that deform when electric energy is applied. The membrane deformation causes ejection of fluid. Thermal inkjet printing technologies, by comparison, employ heating resistors that are heated when electric energy is applied. The heating causes ejection of the fluid,

DETAILED DESCRIPTION

As noted in the background section, fluid-jet printing devices eject fluid onto media by applying electric energy, A fluid-jet printing device has a number of nozzles that individually eject fluid. Electrical energy is typically applied on a per-nozzle basis to cause the nozzles to eject fluid as desired. The electrical energy is usually applied as a waveform. The shape, height, and width, or duration, of the waveform control how a nozzle ejects fluid.

Existing fluid-jet technologies generally employ a single waveform that is applied to each nozzle that is to eject fluid at a given time. However, some nozzles may exhibit fluid-ejection characteristics that differ from other nozzles, due to manufacturing defects and tolerances, nozzle age and wear and tear, and so on. As such, different nozzles may eject fluid in different ways responsive to application of the same waveform, which can result in poor image formation performance of the overall fluid jet printing device.

Disclosed herein are techniques that by comparison permit different waveforms to be applied to different nozzles. There is a corresponding controller for each nozzle of a fluid jet printing device. The controller includes registers to store values for the nozzle. The controller includes a selection circuit to select a waveform from a number of different waveforms, based at least on these values. The controller further includes a scaling circuit to scale the selected waveform, based on the values, This selected and scaled waveform is used to drive the nozzle so that it ejects fluid for a current pixel.

Figure 1:
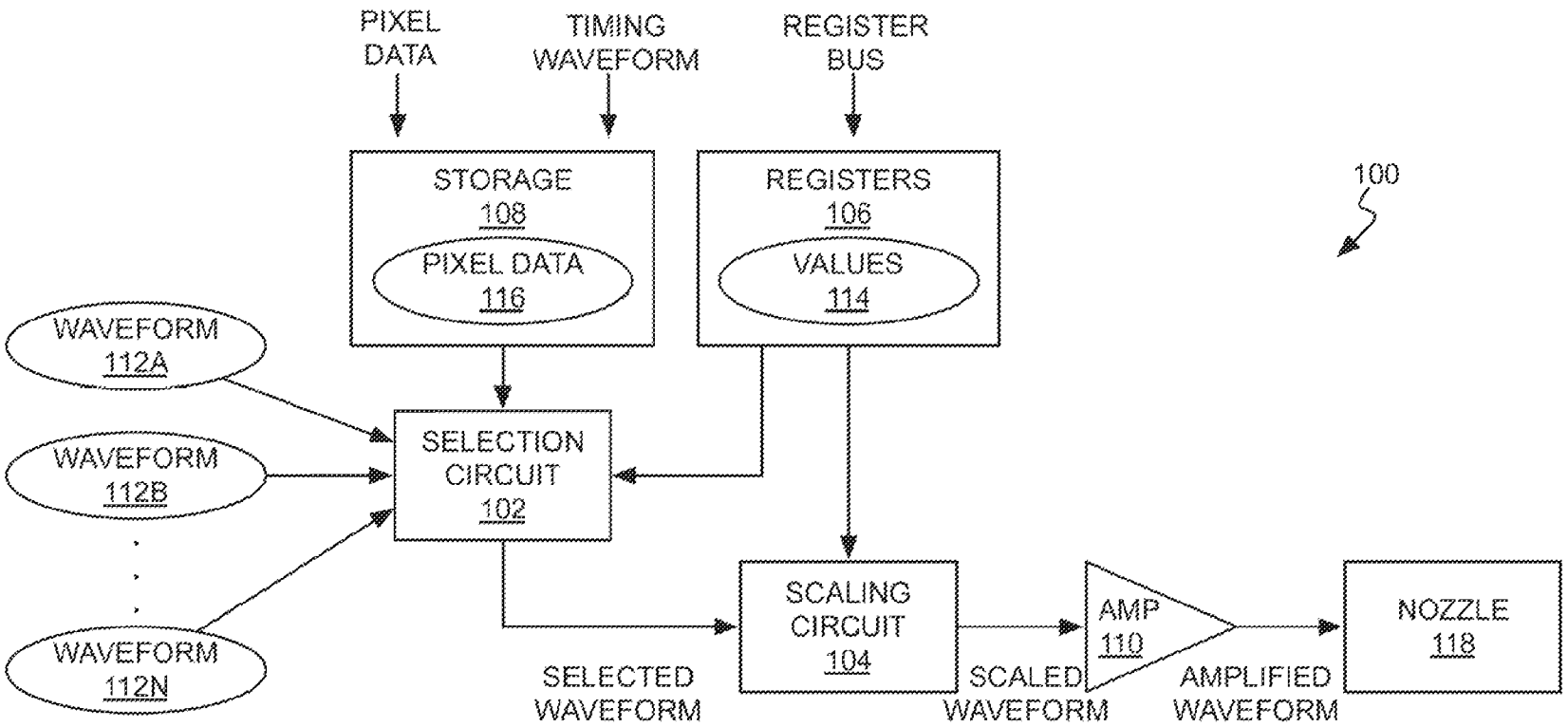
FIG. 1 is a diagram of an example controller for a nozzle a fluid-jet printing device.

FIG. 1 shows an example controller 100 for a nozzle 118 of a fluid-jet printing device. The nozzle 118 may be a piezoelectric nozzle that includes a deformable membrane, or a thermal inkjet nozzle that includes a heating resistor. In both cases, a waveform is applied to the nozzle 118 to drive the nozzle 118 and cause the nozzle 118 to eject fluid therefrom for a current pixel.

The example controller 100 may be implemented as part of a printhead that includes the nozzle 118. For instance, the controller 100 may be implemented on a circuit layer of the printhead. As a particular example, the controller 100 may reside as part of a complementary metal-oxide semiconductor (CMOS) layer of the printhead. A printhead is more generally a fluid-jet ejection mechanism.

The example controller 100 includes a selection circuit 102, a scaling circuit 104, registers 106, another storage 108, and an amplifier 110. The circuits 102 and 104, the registers 106, the storage 108, and the amplifier 110 are each implemented in hardware. From a different part of the fluid-jet printing device of which the controller 100 is a part, pixel data and a timing waveform are received by the storage 108, the registers 106 are connected to a register bus, and the selection circuit 102 receives different waveforms 112A, 112B, 112N, collectively referred to as the waveforms 112.

The registers 106 store values 114 received over the register bus. The values 114 are for the nozzle 118 to which the example controller 100 corresponds. The storage 108 stores pixel data 116 that is received over time in correspondence with a timing waveform. The storage 108 stores at least the current pixel data for a current pixel in accordance with which the nozzle 118 is to eject fluid. The registers 106 and the storage 108 may each be implemented as hardware memory.

The selection circuit 102 selects a waveform from the waveforms 112, based at least on the values 114 for the nozzle 118 stored within the registers 106. The selection circuit 102 may select the waveform also based on the pixel data 116 stored within the storage 108. The scaling circuit 104 scales the selected waveform, also based on the values 114 for the nozzle 118 stored within the registers 106.

The amplifier 110 amplifies the selected and scaled waveform. The resulting selected, scaled, and amplified waveform is applied to the nozzle 118. Application of this waveform to the nozzle 118 causes the nozzle 118 to eject fluid in accordance with the shape, height, and width, or duration, of the waveform.

Selection of a waveform from the waveforms 112 by the selection circuit 102, based on the values 114 within the registers 106, is now described in detail. The selection circuit 102 may be implemented as a multiplexer that selects one of the waveforms 112 based on some of the values 114 stored within the registers 106. For instance, each value 114 may be a bit that has a one or zero value. The selection circuit 102 can use a number of these bits to select one of the waveforms 112, in a multiplexing manner. In general, a number of bits b are used to select among a maximum of 2^b of the waveforms 112.

The different waveforms may each correspond to a unique combination of more than one of time delay, pulse width, and shape. Different waveforms having different time delays, but that are otherwise identically shaped and have identical pulse widths, correct for trajectory of fluid ejected from the nozzle 118. For example, if it is determined that the nozzle 118 ejects fluid with impaired trajectory, then a waveform having an appropriate time delay to correct this impaired trajectory can be selected.

Figure 2:
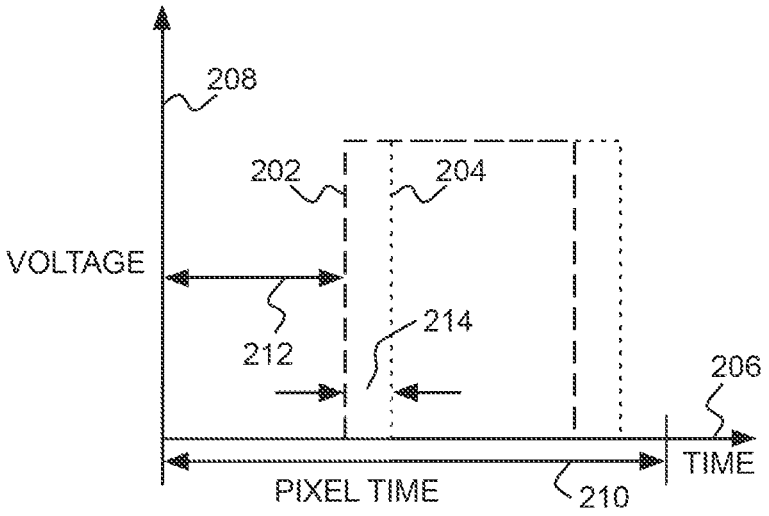
FIG. 2 is a diagram of example waveforms that are for driving nozzle of a fluid-jet printing device and that have different time delays.

FIG. 2 shows two example waveforms 202 and 204 that have different time delays, but that are otherwise identically shaped and have identical pulse widths. An x-axis 206 denotes time, whereas a y-axis 208 denotes voltage. The waveforms 202 and 204 are to be applied to the nozzle 118 within a given pixel time 210, which is the time allotted for the nozzle 118 to eject fluid to form a given pixel on media. This type of waveform adjustment particularly allows for adjustment of the location, along one axis, of where a drop of the fluid ejected by the nozzle 118 lands on the media.

The waveform 202 starts at a time 212 into the pixel time 210. By comparison, the waveform 204 is delayed as compared to the waveform 202, instead starting at a time 214 after the time 212 into the pixel time 210. However, otherwise the waveforms 202 and 204 are identical. That is, the waveforms 202 and 204 have the same shape, and the same width, or duration.

Different waveforms having different pulse widths, but that are otherwise identically shaped and have identical starting time delays, correct for pulse width impairment associated with the fluid ejected by the nozzle 118. Such pulse width impairment may manifest itself as too much or too little fluid being ejected by the nozzle 118. As such, if it is determined that the nozzle 118 ejects fluid with an associated pulse width impairment, then a waveform having an appropriate pulse width to correct this impairment can be selected.

For a nozzle 118 that employs piezoelectric technology to eject fluid, the weight of a drop of the fluid ejected, which is referred to as drop weight, is affected by the height, or voltage, of a pulse, and secondarily by the width of the pulse. By comparison, drop velocity is primarily affected by the pulse width, and secondarily affected by the voltage. For a nozzle 118 that employs thermal technology to eject fluid, the pulse width multiplied by the pulse height affects the amount of energy delivered to eject a drop of fluid. In general, different types of nozzles use different amounts of delivered energy to eject fluid drops. Correction of pulse height (i.e., voltage), pulse width, or both, can thus be used to individually adjust the amount of energy applied to such a nozzle 118 so that just the desired amount of energy is applied to each nozzle. By comparison, existing approaches apply the same amount of energy to each nozzle, which results in the nozzles that use less energy to eject fluid nevertheless receiving more energy—which can wear out these nozzles prematurely and also can cause excess heating.

Figure 3:
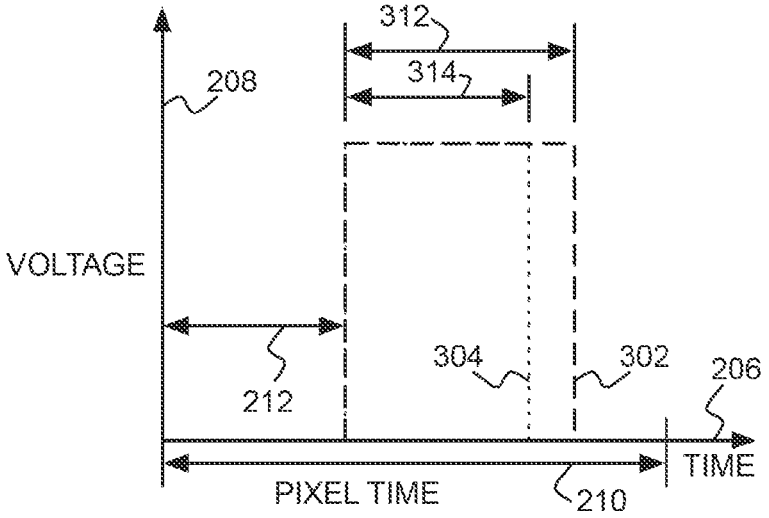
FIG. 3 is a diagram of example waveforms that are for driving a nozzle of a fluid-jet printing device and that have different pulse widths, or durations.

FIG. 3 shows two example waveforms 302 and 304 that have different pulse widths, but that are otherwise identically shaped and have identical time delays. As before, the x-axis 206 denotes time, and the y-axis 208 denotes voltage. The waveforms 302 and 304 are to be applied to the nozzle 118 within the given pixel time 210.

The waveform 302 has a pulse width, or duration, 312, whereas the waveform 302 has a shorter pulse width, or duration, 314. However, otherwise the waveforms 302 and 304 are identical. That is, the waveforms 302 and 304 have the same shape, and start at the same time 212 into the pixel time 210.

Different waveforms having different shapes, but that otherwise have identical pulse widths, or durations, and identical time delays, correct for slew rate variation associated with the fluid ejected by the nozzle 118. Slew rate affects multiple fluid drop ejection characteristics, particularly drop velocity for nozzles that employ piezoelectric technology. Therefore, if it is determined that the nozzle 118 ejects fluid with a slew rate specification that varies from a nominal slew rate, then a waveform having an appropriate shape to correct this variation can be selected.

Figure 4:
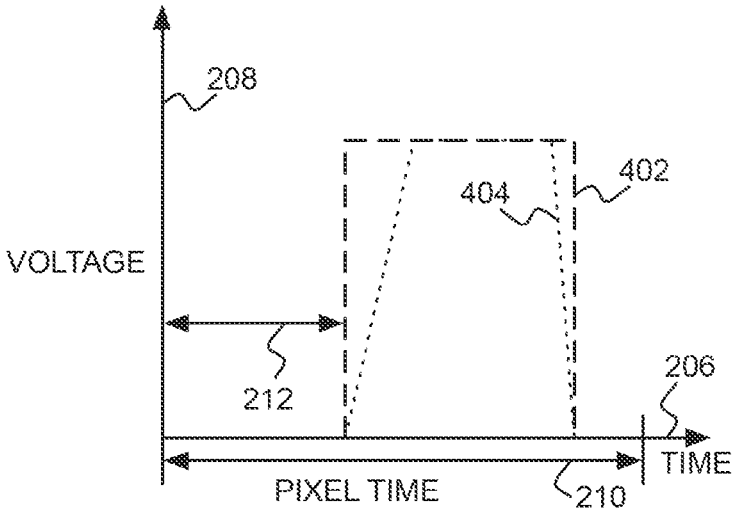
FIG. 4 is a diagram of example waveforms that are for driving a nozzle of a fluid-jet printing device and that have different shapes.

FIG. 4 shows two example waveforms 402 and 404 that have different shapes, but that otherwise have identical pulse widths and identical time delays. As before, the x-axis 206 denotes time, and the y-axis 208 denotes voltage. The waveforms 402 and 404 are to be applied to the nozzle 118 within the given pixel time 210.

The waveforms 402 and 404 have different shapes. The waveforms 402 and 404 have the same width, or duration, and start at the same time 212 into the pixel time 210. The example depicted in FIG. 4 is particular for the case where the nozzle 118 employs piezoelectric technology, in which the rising slope of the pulse is not as great as the falling slope of the pulse.

As noted above, each of the waveforms 112 can correspond to a unique combination of more than one of time delay, pulse width, and shape. For example, one bit of the values 114 may correspond to time delay, one may correspond to pulse width, and one bit may correspond to shape, for a total of 2^3=8 different waveforms 112. In this example, the waveforms 112 represent 2^1=2 different types of time delay, 2^1=2 different types of pulse width, and 2^1=2 different types of shape.

Selection of a waveform from the waveforms 12 by the selection circuit 102, based on the pixel data 116 within the storage 108, is now described in detail. In general, the selection circuit 102 selects a waveform based at least on current pixel data corresponding to the current pixel time. The current pixel data may be binary, being one when the nozzle 118 is to eject fluid to form a pixel on media during the current pixel time, and being zero when the nozzle 118 is not to eject fluid and thus is not to form a pixel on the media during the current pixel time.

Therefore, if the current pixel data is one in this scenario, then the selection circuit 102 selects a waveform from the waveforms 112, such as based on the values 114 stored within the registers 106 as has been described. However, if the current pixel data is zero in this scenario, then the selection circuit 102 selects a null waveform from the waveforms 112, regardless of the values 114 stored within the registers 106. The null waveform may simply be a flat line of zero volts for the duration of the pixel time In this example, then, the values 114 stored within the registers 106 control how the nozzle 118 ejects fluid when the nozzle 118 is to eject fluid, and whether or not the nozzle 118 is to eject fluid is controlled by the current pixel data.

However, in other scenarios, the selection circuit 102 may select a waveform based further on future pixel data and/or past pixel data. Past pixel data corresponds to pixel times that have already occurred, whereas future pixel data corresponds to a pixel that has not yet occurred. Selecting a waveform based on the future pixel data and/or the past pixel data, in addition to the current pixel data, may be desirable when halftoning or another image-improvement or enhancement technique is being employed, and particularly when the pixel data is not binary. In these types of techniques, even if the current pixel data indicates that a pixel is to be formed, or is not to be formed, on media during the current pixel time, the past pixel data and/or the future pixel data is also examined to determine whether to indeed form or not form a pixel during the current pixel time.

As noted above, the storage 108 stores the pixel data 116 in accordance with a timing waveform. The pixel data 116 includes current pixel data, and may include future pixel data for one or more future pixel times, and past pixel data for one or more past pixel times. For example, the pixel data 116 may include current pixel data, future pixel data for the next pixel time and past pixel data for the prior pixel time.

The current pixel data may be gray scale instead of binary, particularly where the nozzle 118 employs piezoelectric technology. In this case, the nozzle 118 can eject a fluid drop during a pixel time that has a drop weight corresponding to the gray scale value of the pixel data. The pixel data has more than one bit, where the number of gray scale levels is equal to two to the power of the number of bits. The number of different waveforms that can be selected is a multiple of the number of gray scale levels, That is, for each different gray scale level there can be a set of different waveforms from which a particular waveform is selected.

Figure 5:
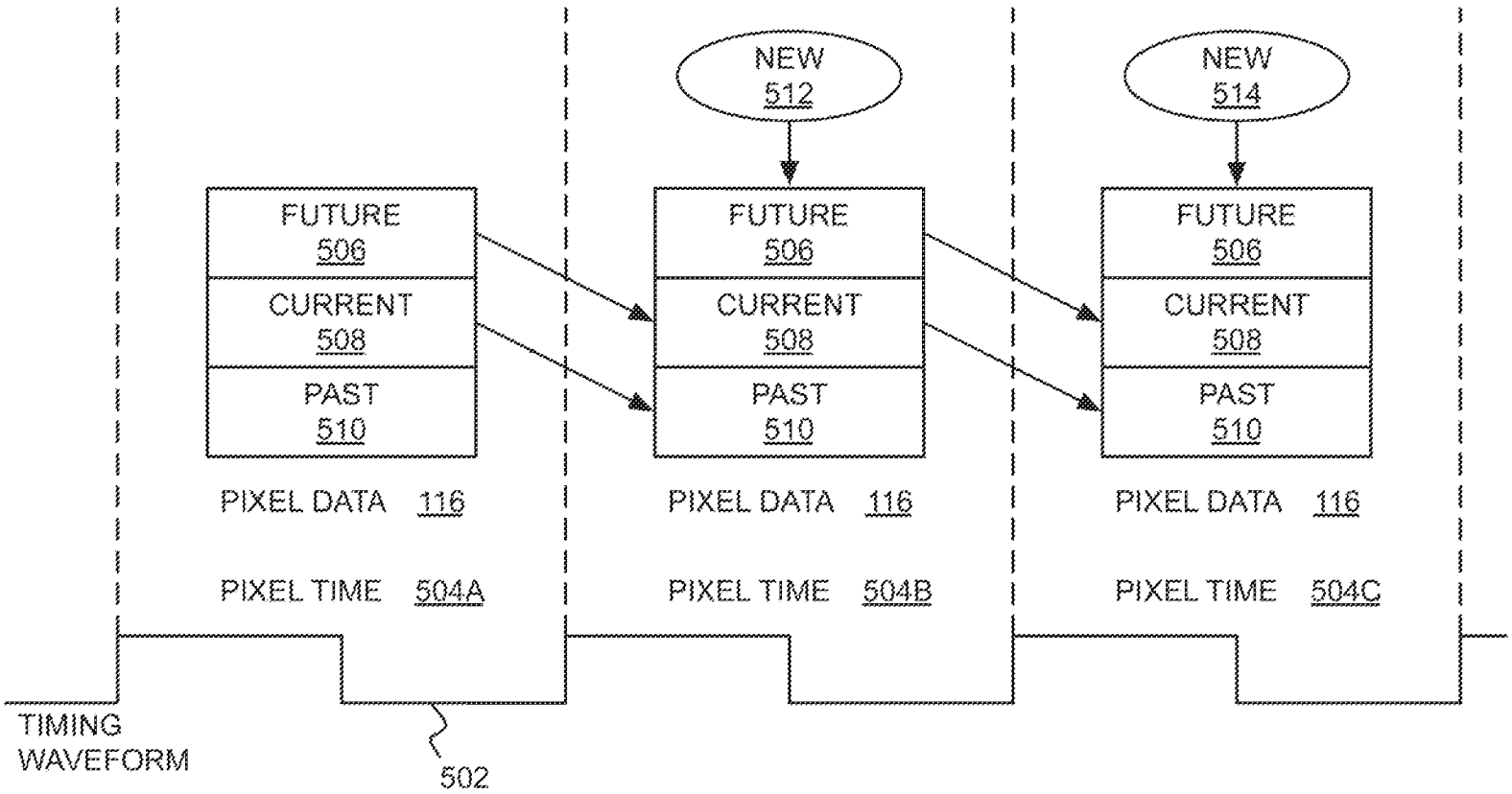
FIG. 5 is a diagram depicting an example of how pixel data is advanced as future pixel data, current pixel data, and past pixel data in accordance with a timing waveform.

FIG. 5 shows an example of how the pixel data 116 is advanced in accordance with a timing waveform 502. The timing waveform 502 in this example is a square wave, where a rising edge signals the beginning of a new current pixel time. FIG. 5 particularly shows three representative pixel times 504A, 504B, and 504C, collectively referred to as the pixel times 504.

When the pixel time 504A is the current pixel time, the pixel data 116 includes future pixel data 506, current pixel data 508, and past pixel data 510. At the pixel time 5048, the past pixel data 510 from the pixel time 504A is discarded, the current pixel data 508 from the pixel time 504A becomes the past pixel data for the pixel time 504B, and the future pixel data 506 from the pixel time 504A becomes the current pixel data 508 for the pixel time 504B. New pixel data 512 is loaded as the future pixel data 506 for the pixel time 504B.

Similarly, at the pixel time 504C, the past pixel data 510 from the pixel time 504B is discard, the current pixel data 508 from the pixel time 504B becomes the past pixel data for the pixel time 504C, and the future pixel data 506 from the pixel time 504B becomes the current pixel data 508 for the pixel time 504C. New pixel data 514 is loaded as the future pixel data 506 for the pixel time 504C. This process repeats at each pixel time, with the previous current pixel data 508 becoming the new past pixel data 510, the previous future pixel data 506 becoming the new current pixel data 508, and new future pixel data 506 being loaded.

Scaling of a selected waveform by the scaling circuit 104, based on the values 114 within the registers 106, is now described in detail. Scaling the selected waveform may be desirable depending on the manufacturing tolerances that governed fabrication of the nozzle 118, as well as the overall lifetime of the nozzle 118. For instance, as the nozzle 118 ages, a higher voltage throughout a waveform may be needed to cause the nozzle 118 to eject fluid as expected as compared to when the nozzle 118 was younger, even if the waveform governing fluid ejection remains the same.

As noted above, the values 114 stored within the registers 106 may each be a bit that has a one or zero value. A number of these bits may thus represent a scaling value by which the selected waveform is to be scaled. When all the bits are each equal to a one value, a maximum voltage throughout the waveform is provided. In general, a number of bits c provide for a scaling value between 0 and 2^c-1.

Figure 6:
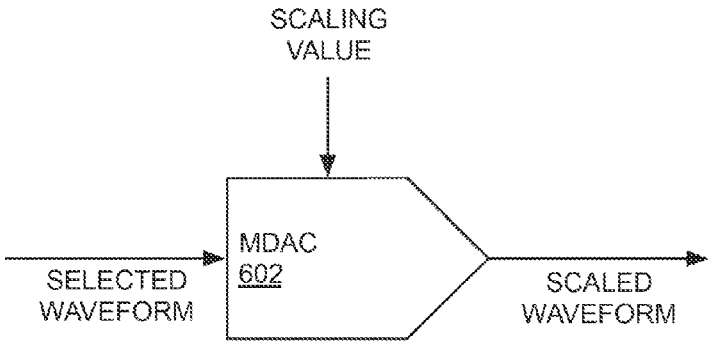
FIG. 6 is a diagram of first example implementation of the scaling circuit of the controller of FIG. 1.

FIG. 6 shows a first example implementation of the scaling circuit 104. In FIG. 6, the scaling circuit 104 is implemented as a multiplying digital-to-analog converter (MDAC) 602. The MDAC 602 receives as input the scaling value as has been described in digital form, as well as the selected waveform in analog form. In response. the MDAC 602 scales the selected analog waveform to a scaled analog form, by multiplying the selected waveform by the scaling value, and outputs the resulting scaled waveform in analog form.

Figure 7:
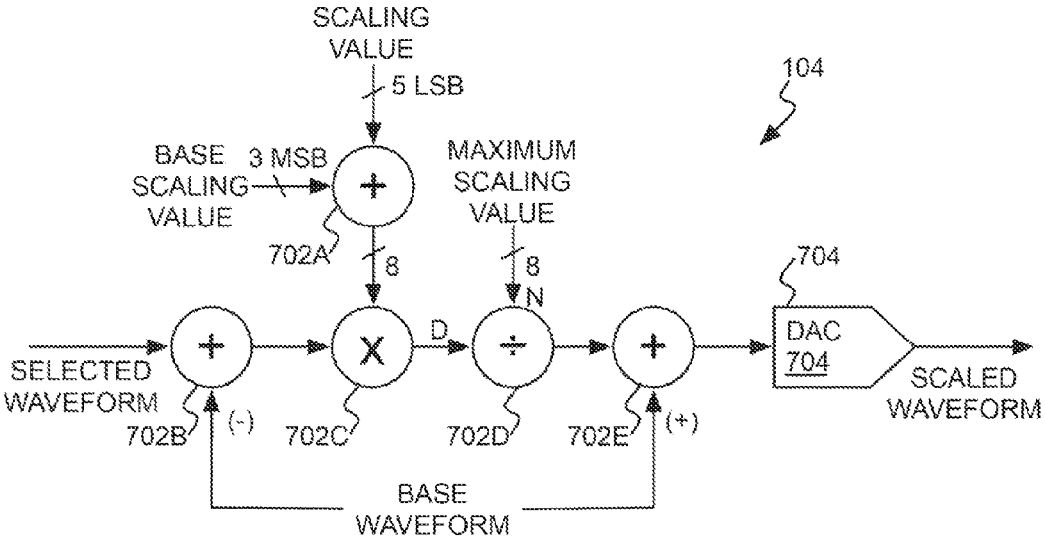
FIG. 7 is a diagram of a second example implementation of the scaling circuit of the controller of FIG. 1.

FIG. 7 shows a second example implementation of the scaling circuit 104. In this example, scaling is achieved digitally, to decrease the amount of circuit area taken up by analog circuitry, which also typically consumes more power and is more noise sensitive than digital circuitry. After scaling in the digital domain, just then is the scaled waveform converted to analog form. In FIG. 7, then, the scaling circuit 104 includes mathematical operational units 702A, 702B, 702C, 702D, and 702E, which are collectively referred to as the mathematical operational units 702. Each mathematical operational unit 702 performs a mathematical operation, such as addition (including subtraction), multiplication, or division. The scaling circuit 104 also includes a digital-to-analog converter (DAC) 704 in FIG. 7.

The addition mathematical operational unit 702A adds the scaling value, which represents a number of least significant bits, such as five least significant bits, to a number of most significant bits, such as three most significant bits, represented by a base scaling value. The addition mathematical operational unit 702B subtracts a base waveform in digital form, which may be the waveform that is applied to the nozzle 118 when no fluid is to be ejected, from the selected waveform. The multiplication mathematical operational unit multiplies the output of the mathematical operational units 702A and 702B together.

The division mathematical operational unit 702D divides a maximum scaling value, which has a number of bits equal to sum of the number of the least significant bits represented by the scaling value and the number of the most significant bits represented by the base scaling value, by the output of the mathematical operational unit 702C. As such, the division mathematical operational unit 702D performs the mathematical operation NM, where N is the maximum scaling value and D is the output of the mathematical operational unit 702C. The addition mathematical operational unit 702E then adds the base waveform to the output of the mathematical operational unit 702D.

The mathematical operational units 702 operate in the digital domain, insofar as the selected waveform is in digital form. Therefore, the DAC 704 converts the output of the mathematical operational unit 702E to analog form. The output of the DAC 704 is the scaled waveform prior to final amplification.

It is noted that because the controller 100 is for a particular nozzle 118 of the fluid-jet device, the values 114 can be particular to this nozzle 118, to compensate for characteristics of the nozzle 118 individually, regardless of the characteristics of other nozzles of the fluid-jet device. The values 114 stored in the registers 106 are generally static, but may be changed periodically, such as when the nozzle 118 undergoes calibration. Therefore, as the timing waveform causes the pixel data 116 stored within the storage 108 to change, and as the nozzle 118 ejects fluid, the values 114 will normally remain the same, except when, for instance, the nozzle 118 is calibrated.

While the controller 100 corresponds to just one nozzle 118, and is not for any other nozzle of the fluid-jet device, the nozzle 118 itself may have more than one controller 100. Some types of fluid-jet printing devices, such as piezoelectric fluid-jet printing devices, have their nozzles eject fluid over more than one phase. There may thus be a separate controller 100 for each phase of the nozzle 118. As another implementation, the multiple controllers 100 for the multiple phases of the nozzle 118 may share some components with one another. However, regardless of the number of phases, the controller 100 is for just one nozzle 118.

Figure 8:
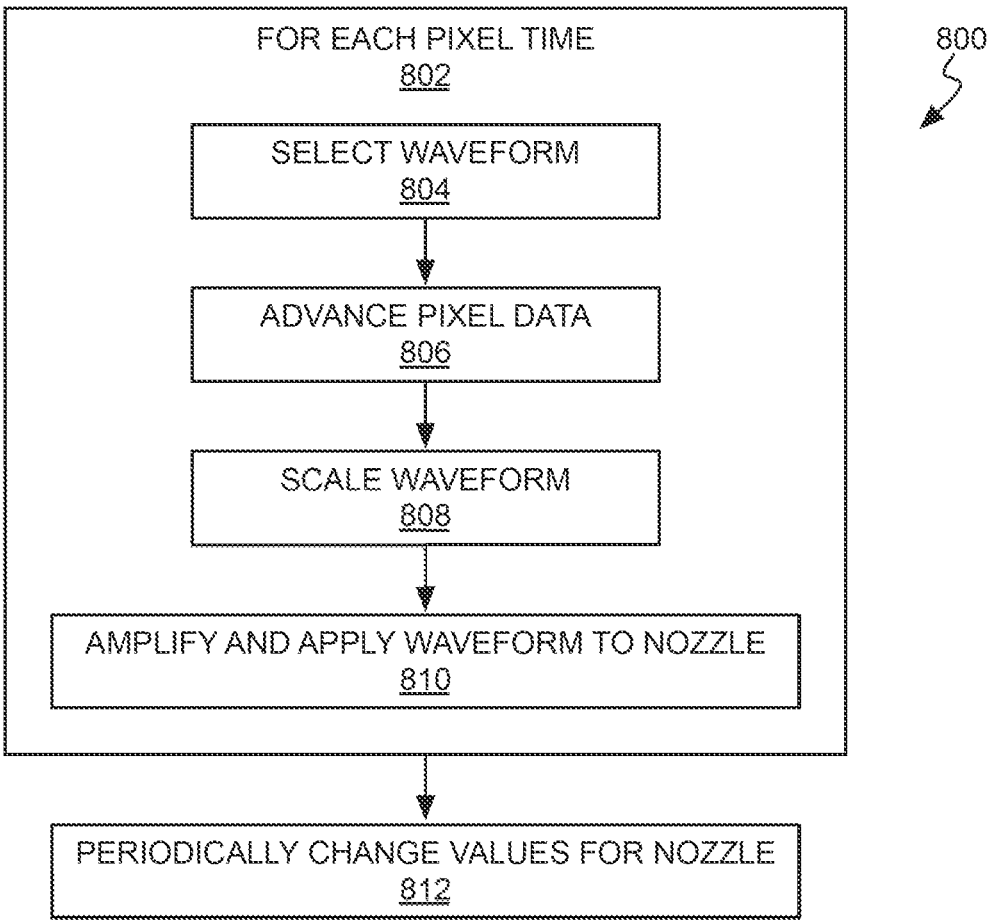
FIG. 8 is a flowchart of an example method for driving a nozzle of a fluid-jet printing device using the controller of FIG. 1.

FIG. 8 shows an example method 800 for driving the nozzle 118 using the controller 100 that depicts this process. For each pixel time of a number of successive pixel times for forming an image on media, the following is performed for the nozzle 118 (802). The selection circuit 102 selects a waveform from the waveforms 112 (804), as has been described. The pixel data 116 stored within the storage 108 can be advanced, based on a timing waveform (806), as has also been described. The scaling circuit 104 scales the selected waveform (808), as has been described, and the waveform is amplified and applied to the nozzle 118 (810), to cause the nozzle 118 to eject fluid therefrom.

Apart from this process 802, however, the values 114 for the nozzle 18 stored within the registers 106 may be periodically changed (812). This is generally performed in-between instances of forming an image, on media, such as between print jobs or between pages or sheets of a print job, but may also be performed between two adjacent pixel times in some scenarios. However, the values 114 for the nozzle 118 stored within the registers 106 are for the most part generally static, as noted above, and typically do not change between each pair of adjacent pixel times.

Figure 9:
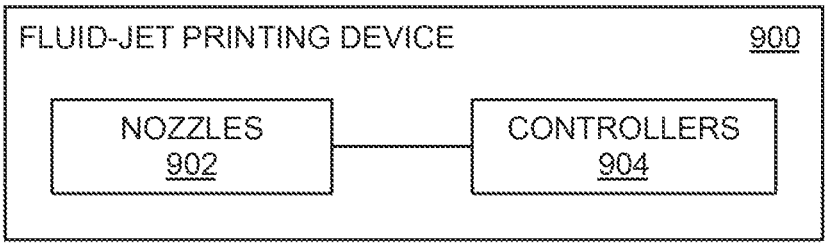
FIG. 9 is a diagram of an example fluid-jet printing device.

FIG. 9 shows a block diagram of an example rudimentary fluid-jet printing device 900. The fluid-jet printing device 900 includes a number of nozzles 902, and corresponding controllers 904. Each controller 904 is for just one of the nozzles 902, although each nozzle 902 may have more than one controller 904. The controllers 904 may each be implemented as the controller 100 that has been described.

The fluid-jet printing device 900 may be an inkjet-printing device, which is a device, such as a printer, that ejects ink onto media, such as paper, to form images, which can include text, on the media. The fluid-jet printing device 900 is more generally a fluid-ejection precision-dispensing device that precisely dispenses fluid, such as ink. The fluid-jet printing device 900 may eject pigment-based ink, dye-based ink, another type of ink, or another type of fluid. Examples of other types of fluid include those having water-based or aqueous solvents, as well as those having non-water-based or non-aqueous solvents. The examples described herein can thus pertain to any type of fluid-ejection precision-dispensing device that dispenses a substantially liquid fluid.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids thus include drugs, cellular products, organisms, fuel, and so on, which are not substantially or primarily composed of gases such as air and other types of gases, as can be appreciated by those of ordinary skill within the art.

We claim:

1. A controller for driving a nozzle of a fluid-jet printing device, comprising:

a plurality of registers to store a plurality of values each corresponding to a waveform time delay, a waveform pulse width, or a waveform shape for the nozzle of the fluid-jet printing device;

a selection circuit to select a waveform from a plurality of waveforms, based at least on values corresponding to a more than one of time delay, pulse width and shape stored within the registers; and wherein the waveform is to drive the nozzle to cause the nozzle to eject fluid therefrom for a current pixel.

2. The controller of claim 1, wherein the selection circuit is to use the values stored by one or more given registers of the registers to select the waveform to correct trajectory of the fluid ejected from the nozzle, and wherein the waveforms comprise a plurality of identically shaped waveforms that have identical pulse widths but that vary from one another by time delays.

3. The controller of claim 1, wherein the selection circuit is to use the values stored by one or more given registers of the registers to select the waveform to correct pulse width associated with the fluid ejected from the nozzle, and wherein the waveforms comprise a plurality of identically shaped waveforms that have identical time delays but that vary from one another by pulse widths.

4. The controller of claim 1, wherein the selection circuit is to use the values stored by one or more given registers of the registers to select the waveform to correct slew rate variation associated with the fluid ejected from the nozzle, and wherein the waveforms comprise a plurality of waveforms that have identical pulse widths and identical time delays but that vary from one another by shape.

5. The controller of claim 1, wherein each waveform corresponds to a unique combination of two or more of: time delay, pulse width, and shape.

6. The controller of claim 1, further comprising a storage to store current pixel data for the nozzle, wherein the selection circuit is to select the waveform based also on the current pixel data for the nozzle.

7. The controller of claim 6, wherein the storage is further to store one or more of future pixel data and past pixel data for the nozzle, wherein the selection circuit is to select the waveform based also on the one or more of the future pixel data and the past pixel data for the nozzle.

8. The controller of claim 7, wherein the storage is to receive a timing waveform on which basis the storage specifies presently and previously received pixel data for the pixel as the current pixel data, the future pixel data, and the past pixel data in correspondence with a current pixel time.

9. The controller of claim 1, further comprising a scaling circuit to scale the waveform based on the values stored within the registers.

10. The controller of claim 9, wherein the scaling circuit comprises a multiplying digital-to-analog converter to scale the waveform selected.

11. The controller of claim 9, wherein the scaling circuit comprises:

one or more mathematical operational units, each mathematical operational unit to perform a mathematical operation on the waveform selected to change the waveform selected; and, a digital-to-analog converter to convert the waveform selected from digital to analog.

12. A fluid-jet printing device comprising:

a plurality of nozzles, each nozzle to eject fluid therefrom in correspondence with being driven; and, a plurality of controllers corresponding to the nozzles, each controller to drive a different nozzle of the nozzles by selecting a waveform from a plurality of waveforms based at least on values for the different nozzle, scaling the waveform selected based on the values, and applying the waveform selected, as scaled, to the different nozzle, each controller comprising:

a plurality of registers to store a plurality of values each corresponding to a waveform time delay, a waveform pulse width, or a waveform shape for the nozzle;

a selection circuit to select a waveform from a plurality of waveforms, based at least on values corresponding to more than one of time delay, pulse width and shape stored within the registers; and a scaling circuit to scale the waveform, based on the values stored within the registers;

wherein the waveform is to drive the nozzle to cause the nozzle to eject fluid therefrom for a current pixel.

* * * * *